US006315630B1

(12) United States Patent
Yamasaki

(10) Patent No.: US 6,315,630 B1
(45) Date of Patent: Nov. 13, 2001

(54) REMOTELY CONTROLLED SKATEBOARD HAVING MOTION-RESPONSIVE DOLL RIDING THEREON

(75) Inventor: Toshio Yamasaki, Long Beach, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/498,418

(22) Filed: Feb. 4, 2000

(51) Int. Cl.[7] ..... A63H 11/00; A63H 15/00; A63H 17/25

(52) U.S. Cl. ..... 446/275; 446/279; 446/288

(58) Field of Search ..... 446/275, 279, 446/288, 456, 462, 465

(56) References Cited

U.S. PATENT DOCUMENTS

| | | | | |
|---|---|---|---|---|
| 1,439,592 | | 12/1922 | Wheeldon . | |
| 1,610,900 | * | 12/1926 | Strauss et al. | 446/288 |
| 3,199,249 | | 8/1965 | Carver et al. . | |
| 3,379,441 | * | 4/1968 | Feather et al. | 446/288 X |
| 3,472,333 | | 10/1969 | Loewenstern, Jr. . | |
| 3,574,969 | * | 4/1971 | Cleveland et al. | 446/275 |
| 4,073,356 | | 2/1978 | Schlicht . | |
| 4,094,372 | | 6/1978 | Notter . | |
| 4,143,728 | | 3/1979 | Shiber . | |
| 4,208,834 | | 6/1980 | Lin . | |
| 4,374,548 | | 2/1983 | Ueno et al. . | |
| 4,457,101 | | 7/1984 | Matsushiro . | |
| 4,480,401 | | 11/1984 | Matsushiro . | |
| 4,836,819 | * | 6/1989 | Oishi et al. | 446/288 |
| 4,846,752 | | 7/1989 | Combs . | |
| 5,020,621 | | 6/1991 | Martin . | |
| 5,224,719 | | 7/1993 | Goodspeed . | |
| 5,238,441 | * | 8/1993 | Llorens | 446/288 |
| 5,330,026 | | 7/1994 | Hsu et al. . | |
| 5,580,296 | | 12/1996 | Chow . | |
| 6,074,271 | * | 6/2000 | Derrah | 446/288 X |

FOREIGN PATENT DOCUMENTS

| | | | | |
|---|---|---|---|---|
| 8611067 | | 8/1987 | (GB) . | |
| 2184662 | * | 7/1987 | (GB) | 446/279 |

* cited by examiner

*Primary Examiner*—John A. Ricci
(74) *Attorney, Agent, or Firm*—Roy A. Ekstrand

(57) ABSTRACT

A skateboard and remote control unit cooperate to provide remotely controlled movement of a skateboard in response to user commands. A doll is secured upon the upper surface of the skateboard in a standing position characteristic of typical skateboarders. The doll includes an upper torso freely pivotable upon a lower torso by a pivotal attachment therebetween. The upper torso further supports a pair of freely pivotable arms. An offset weight is secured within the doll upper torso to cause response to momentum changes by the skateboarding doll as the skateboard moves about. The doll upper torso and the doll arms freely move in response to momentum changes of the skateboard to provide a realistic appearing skateboarding doll.

13 Claims, 4 Drawing Sheets

REMOTELY CONTROLLED SKATEBOARD HAVING MOTION-RESPONSIVE DOLL RIDING THEREON

FIELD OF THE INVENTION

This invention relates generally to toy skateboards and particularly to those which are power driven and remotely controlled.

BACKGROUND OF THE INVENTION

Skateboarding has become a well known and extremely popular sport and recreation activity. With the rise of skateboard popularity, practitioners of the toy arts have been prompted to respond by providing various types of toy skateboards. In addition, further developments in skateboard technology has led to power driven variations of skateboards. Here again, practitioners of the toy arts have responded to skateboard technology and popularity by providing toy skateboards which mimic more newly developed power driven skateboards. For example, British patent 2,186,501 issued to Berenguer et al. sets forth a TOY COMPRISING A DOLL AND SKATEBOARD in which a skateboard supporting a riding doll is provided with a radio control unit and an appropriate propulsion device. The doll rides upon the skateboard by utilizing a plurality of fittings and anchoring devices which cooperate between the upper surface of the skateboard and the doll.

U.S. Pat. No. 4,846,752 issued to Combs sets forth a REMOTE CONTROLLED ROLLER SKATING TOY having a female figure supporting an internal power source and a remote control signal receiving device. The doll is supported by a pair of roller skates which are driven by independent power sources under the control of the remote control receiver. By varying the power applied to each of the dolls roller skates, the direction of travel of the doll may be guided.

U.S. Pat. No. 4,143,728 issued to Shiber sets forth a MOTORIZED SKATEBOARD having a drive axle with a drive wheel coupled to a prime mover and an idler wheel wherein the drive wheel is made to support more weight than the idler wheel in order to improve traction of the skateboard.

U.S. Pat. No. 4,094,372 issued to Notter sets forth a MOTORIZED SKATEBOARD WITH UNIDIRECTIONAL REAR MOUNTING having a skateboard with supporting front wheels and power driven rear wheels. An internal combustion engine is supported upon the rear of the skateboard and is operatively coupled to the rear wheels by a chain drive mechanism.

U.S. Pat. No. 4,073,356 issued to Schlicht sets forth a MOTORIZED SKATEBOARD having an elongated planar board supported by pairs of front and rear wheels. A pair of driven wheels is supported at the approximate center of the board and is operative in combination with an internal combustion engine coupled to the drive wheels.

U.S. Pat. No. 5,330,026 issued to Hsu et al. sets forth a REMOTE CONTROLLED ELECTRIC SKATEBOARD having an elongated generally planar board supported by a pair of front wheels and a pair of rear wheels. An electric motor is operatively coupled to the front wheels and is driven by an electric power source supported by the skateboard just behind the power driven front wheels.

U.S. Pat. No. 4,374,548 issued to Ueno et al. sets forth a PLAYING VEHICLE WITH A PRIME MOVER having an elongated chassis supporting a seated driver and a pair of control levers. A pair of front wheels supports the front end of the vehicle and a pair of power driven rear wheels is supported at the rear portion of the vehicle. Power is provided by a small internal combustion engine positioned over the rear wheels.

U.S. Pat. No. 5,020,621 issued to Martin sets forth an ELECTRIC MOTOR POWERED SKATEBOARD WITH INTEGRAL BRAKES having an elongated board supporting by front and rear wheel pairs. An electric motor powers the front wheels which further support a set of operable brakes. The brakes are coupled to an elongated control cable which in turn is coupled to a hand grip held by the user riding upon the skateboard.

U.S. Pat. No. 5,224,719 issued to Goodspeed sets forth a SKATEBOARD having an elongated board supported by front and rear wheels. The board further supports a pivotal pedal which is movable as the user places weight upon the pedal to couple mechanical power to the rear wheels of the skateboard.

U.S. Pat. No. 4,480,401 issued to Matsushiro sets forth a RADIO CONTROLLED CAR while U.S. Pat. No. 4,457,101 also issued to Matsushiro sets forth a RADIO CONTROLLED TOY CAR and U.S. Pat. No. 5,580,296 issued to Chow sets forth a TOY VEHICLE WITH CHANGEABLE APPEARANCE AS FUNCTION OF DIRECTION OF MOVEMENT all of which patents set forth typical remote controlled toy vehicles.

U.S. Pat. No. 4,208,834 issued to Lin sets forth REMOTE RADIO CONTROLLED INFLATABLE TOYS having inflated bodies which are supported by power driven wheels on the bottom surfaces thereof.

U.S. Pat. No. 3,199,249 issued to Carver et al. and U.S. Pat. No. 1,439,592 issued to Wheeldon set forth early examples of toy figures riding upon a transport platform supported by a plurality of rolling wheels.

U.S. Pat. No. 3,427,333 issued to Loewenstern, Jr. sets forth a REMOTE CONTROLLED WHEELED GOLF CLUB CARRIER having an otherwise conventional cart adapted to receive and carry sets of golf clubs which is powered by an electric motor and which is guided by a remote control unit.

While the foregoing described prior art devices have to some extent improved the art and in some instances enjoyed commercial success, there remains nonetheless a continuing need in the art for a more realistic and interesting remotely controlled skateboard and doll riding thereon.

SUMMARY OF THE INVENTION

Accordingly, it is a general object of the present invention to provide an improved skateboard toy. It is a more particular object of the present invention to provide an improved skateboard toy which carries a riding doll and which is remotely controlled. It is a still more particular object of the present invention to provide an improved remotely controlled skateboard having a doll riding thereon which provides additional realism particularly on the part of the doll.

In accordance with the present invention there is provided a skateboard and skateboarding doll in combination, the combination comprising: a remotely controlled skateboard having a board, a plurality of wheels and chassis supporting the board, and means for moving and steering the skateboard; a skateboarding doll having a lower torso, a pair of legs, a pair of feet, an upper torso, a pair of arms, the upper and lower torsos having freely pivotable coupling means therebetween; and attachment means for removably securing the pair of feet to the board supporting the skateboarding doll in a generally upright posture upon the skateboard, the upper torso having an offset weight distribution relative to the coupling means causing the upper torso to move with respect to the lower torso in response to acceleration and momentum changes of the skateboard.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
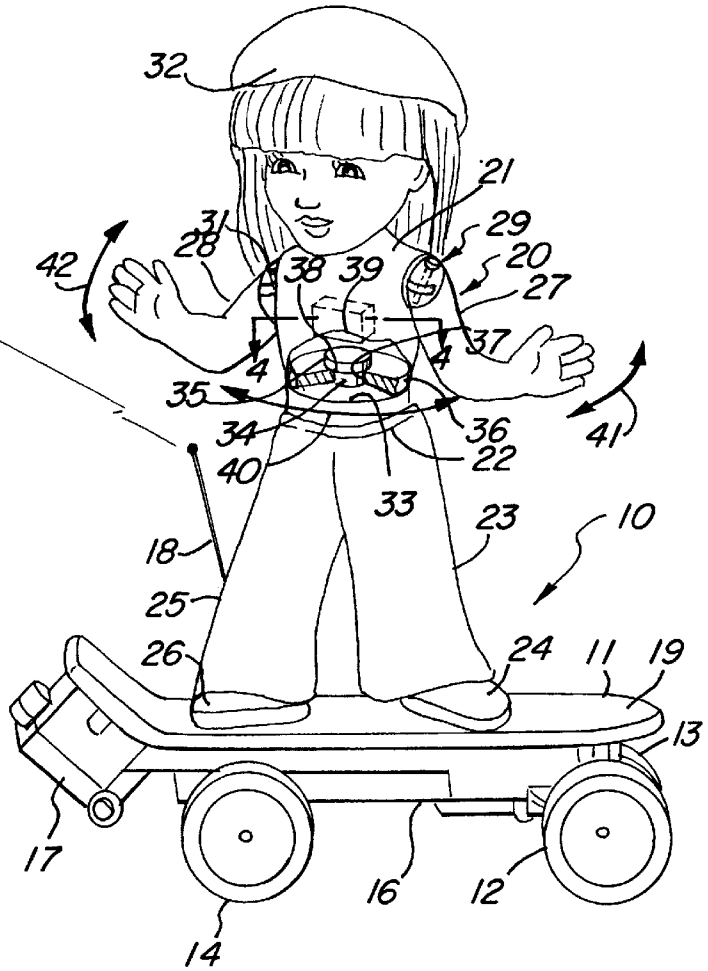
FIG. 1 sets forth a partially sectioned perspective view of a remotely controlled skateboard and riding doll constructed in accordance with the present invention.

FIG. 1 sets forth a perspective view of a remotely controlled skateboard having a re-motion responsive doll riding thereon constructed in accordance with the present invention. The inventive combination includes a skateboard 10 upon which a doll 20 is riding and which is remotely controlled by a remotely controlled transmitter 30. Remote control transmitter 30 may be fabricated in accordance with conventional fabrication techniques and is manipulated in the hands of a user to transmit operational commands to skateboard 10. Signals sent by remote control unit 30 are received by an antenna 18 supported upon skateboard 10. Skateboard 10 responds to received commands at antenna 18 in accordance with conventional remote control fabrication techniques to control the drive mechanism within skateboard 10 (seen in FIG. 3) as well as the steering mechanism of skateboard 10 (seen in FIG. 6). Thus, skateboard 10 includes a generally planar board 11 defining an upper surface 19. Board 11 is supported by a chassis 16 which in turn is supported by a pair of front wheels 12 and 13 and a pair of rear wheels 14 and 15 (wheel 15 seen in FIG. 2). Chassis 16 further includes a battery case 17 within which a plurality of conventional batteries (not shown) provide operative power for skateboard 10.

Doll 20 includes a lower torso 22 supported by a pair of legs 23 and 25 which in turn are supported upon surface 19 of board 11 by a pair of feet 24 and 26. By means set forth below in FIG. 2, feet 24 and 26 are removably secured to surface 19 of board 11. Suffice to note here, that doll 20 is secured to surface 19 and moves with skateboard 10.

Doll 20 further includes an upper torso 21 having a pair of shoulder joints 29 and 31 which in turn pivotally support a pair of arms 27 and 28. Shoulder joints 29 and 31 are freely pivotal joints allowing arms 27 and 28 to move freely in the directions indicated by arrows 41 and 42. Doll 10 further includes a head 32 secured to upper torso 21 by a conventional attachment (not shown).

In accordance with an important aspect of the present invention, lower torso 22 defines a plate 33 while upper torso 21 defines a similar plate 36. Plate 33 includes an upwardly extending post 34 having a head 35 formed thereon. Correspondingly, plate 36 defines an aperture 37 through which post 34 extends. The enlargement of head 35 provides an attachment between plate 33 and 36 while aperture 37 and post 34 cooperate to provide a freely pivotal character to the attachment between upper torso 21 and lower torso 22. In addition, and as is set forth below in FIG. 4 in greater detail, upper torso 21 further supports a weight 39 positioned against the frontal surface of upper torso 21. The position of weight 39 against the front interior surface of upper torso 21 produces an off-center weight distribution which causes upper torso 21 to freely pivot with respect to lower torso 22 in the directions indicated by arrows 40 in response to acceleration and braking forces as well as side-to-side forces produced as skateboard 10 is driven about. Similarly, the freely pivotal attachment of shoulder joints 29 and 31 allows arms 27 and 28 to undergo similar momentum induced pivotal movements as skateboard 10 is driven about. The degree of pivotal movement of upper torso 21 with respect to lower torso 22 is limited by the use of a slot 38 formed in plate 36. As is better seen in FIG. 4, plate 33 supports an upwardly extending post 48 which is received within slot 38. The cooperation of post 48 and slot 38 provide the limitation of angular or pivotal movement of upper torso 21.

In operation, with doll 20 secured to skateboard 10 and with the user operating remote control unit 30, the user drives skateboard 10 around in much the same manner as is typical of the play pattern exercised with remote control toy vehicles or the like. Skateboard 10 includes conventional control circuitry which allows steering of skateboard 10 as well as locomotion in forward or rearward directions in response to control signals received within remote control 30. In accordance with an important aspect of the present invention, the various acceleration forces to which doll 20 is subjected due to movement and changes of movement on the part of skateboard 10 produce pivotal movement of upper torso 21 and arms 27 and 28. This movement is obtained entirely due to momentum changes and requires no motor power unit within doll 20. The result is a more realistic appearance for doll 20 upon skateboard 10 as the doll "reacts" to the actions of the skateboard in a similar fashion to a human skateboard user responding to maintain balance as the skateboard activity proceeds.

In accordance with a further advantage of doll 20, skateboard 10 and doll 20 may be separated allowing skateboard 10 to be used without doll 20 and allowing doll 20 to be played with conventional doll play patterns.

Figure 2:
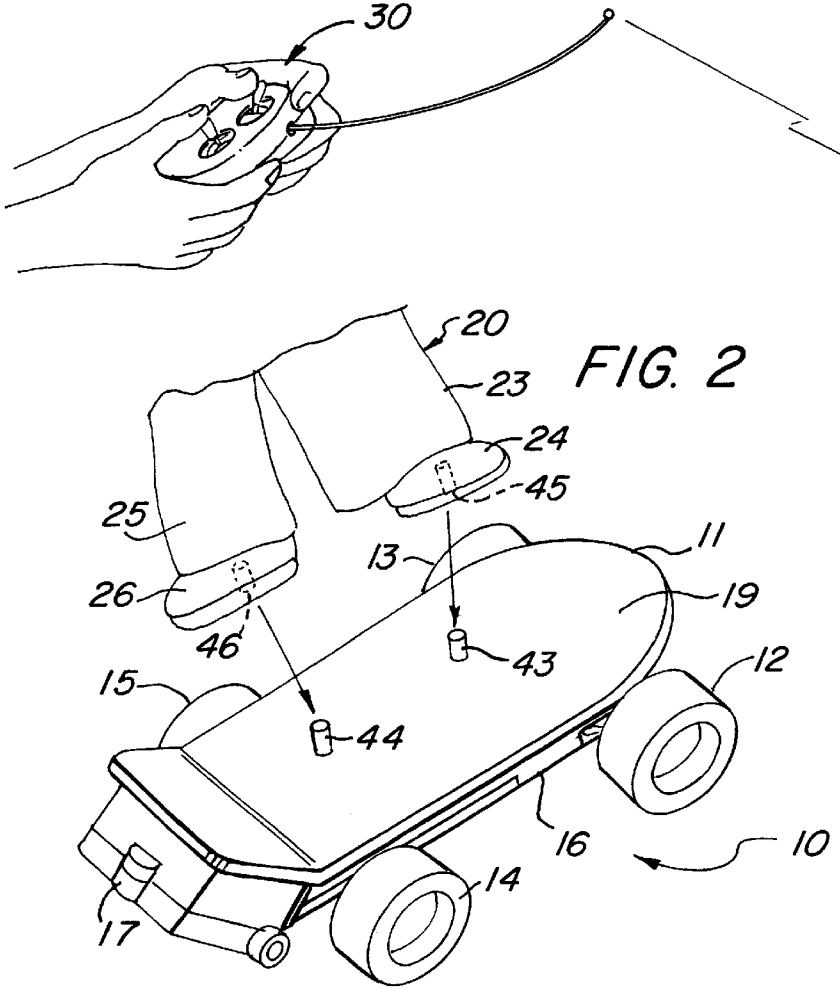
FIG. 2 sets forth a partial perspective assembly view of the present invention remotely controlled skateboard and riding doll showing the attachment of the doll to the skateboard.

FIG. 2 sets forth a partial perspective view of skateboard 10 together with doll 20. More specifically skateboard 10 includes a generally planar board 11 defining an upper surface 19 which in turn supports a pair of upwardly extending posts 43 and 44. Board 11 is supported by a chassis 16 which in turn supports a plurality of wheels 12, 13, 14 and 15. In addition, chassis 16 includes a battery case 17 within which a plurality of conventional batteries (not shown) are supported. Doll 20 includes a pair of legs 23 and 25 having respective feet 24 and 26. Foot 24 defines an aperture 45 while foot 26 defines an aperture 46. Apertures 45 and 46 are sized and configured in cooperation with posts 43 and 44 to facilitate a secure yet removable attachment between feet 24 and 26 and board 11. In accordance with an important aspect of the present invention, doll 20 is fully removable from skateboard 10 allowing independent use of either doll 20 or skateboard 10.

Figure 3:
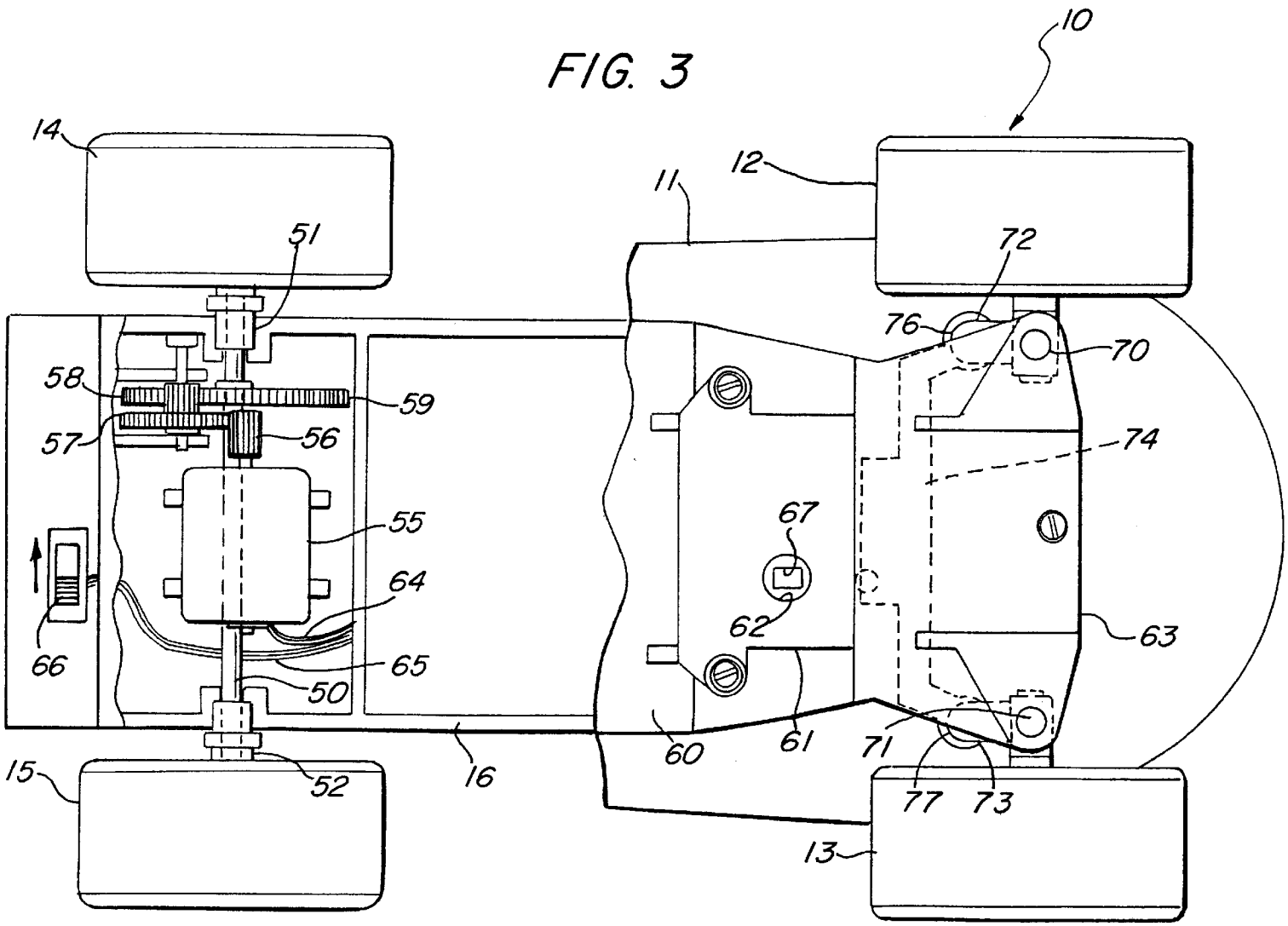
FIG. 3 sets forth a partially sectioned bottom view of the present invention remotely controlled skateboard.

FIG. 3 sets forth a partially sectioned bottom view of skateboard 10. As described above, skateboard 10 includes a board 11 supported by a chassis 16. Chassis 16 supports an on/off switch together with a chassis plate 60. A pair of front wheels 12 and 13 are pivotally supported by chassis 16 using a pair of pivots 70 and 71. Pivot 70 includes an arm 72 while pivot 73 includes an arm 73. Arms 72 and 73 are coupled to a traverse arm 74 by a pair of pivots 76 and 77 respectively.

Chassis 16 further supports an alignment trim adjuster 80 (seen in FIG. 5) beneath an aperture 62 formed in chassis plate 60. Alignment trim adjuster 80 includes a socket 67 accessible through aperture 62 which may receive the end of a tool such as a screwdriver or the like to provide adjustment. The adjustment of alignment trim adjuster 80 (seen in FIG. 5) is described below in greater detail. However, suffice it to note here, that the user is able to insert a tool such as a screwdriver into socket 67 and adjust or trim the straight line alignment of skateboard 10.

Skateboard 10 further includes a drive motor 55 having an output gear 56 which in turn is coupled to a compound gear 57 and 58. Gear 58 engages an axle gear 59. Axle gear 59 is secured to an axle 50 which is supported upon chassis 16 by a pair of bearings 51 and 52. Axle 50 further supports rear wheels 14 and 15. Operative power from motor 55 in either direction of rotation is coupled to rear wheels 14 and 15 by the cooperation of gears 56 through 59. A plurality of connecting wires 64 and 65 operatively couples switch 66 and motor 55 to circuit module 90 (seen in FIG. 6).

Figure 4:
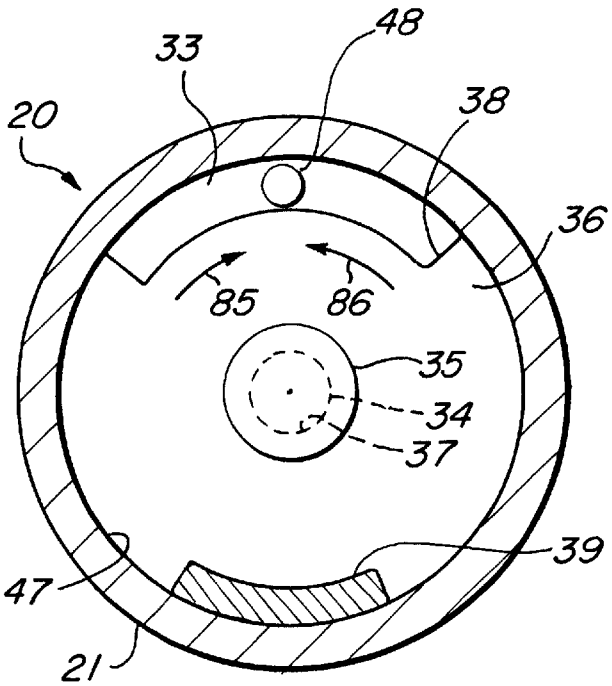
FIG. 4 sets forth a section view of the doll of the present invention remotely controlled skateboard and riding doll taken along section lines 4—4 in FIG. 1.

FIG. 4 sets forth a section view of doll 20 taken along section lines 4—4 in FIG. 1. Doll 20 includes an upper torso 21 having a plate 36 at the bottom end thereof. Plate 36 defines and aperture 37 and a curved slot 38. Upper torso 21 defines an interior surface 47 to which a weight 39 is secured. Doll 20 further includes a plate 33 which as is better seen in FIG. 1, is formed upon the upper portion of lower torso 22. Plate 33 is seen through slot 38. Plate 33 further supports an upwardly extending post 48 which is received within slot 38 of plate 36. Plate 33 further defines an upwardly extending post 34 which is received within aperture 37. Post 34 is sufficiently smaller in size than aperture 37 to provide a freely rotatable attachment between plates 36 and 33. Post 34 further includes an enlarged head 35 which secures the attachment between plates 33 and 36.

In operation, the offset position of weight 39 with respect to the rotational center provided by post 34 and aperture 37 of doll 20 causes upper torso 21 to freely pivot upon post 34 as doll 20 is subject to various inertial or momentum forces as skateboard 10 (seen in FIG. 1) moves about carrying doll 20. The extent of rotation of upper torso 20 in the manner indicated by arrows 85 and 86 is limited by the cooperation of post 48 and the end portions of slot 38. Thus, in the example shown in FIG. 4, doll 20 is able to pivot upper torso 21 through a range of approximately ninety degrees. It will be apparent to those skilled in the art that appropriate sizes for slot 38 may be selected to alter this range of motion without departing from the spirit and scope of the present invention.

Figure 5:
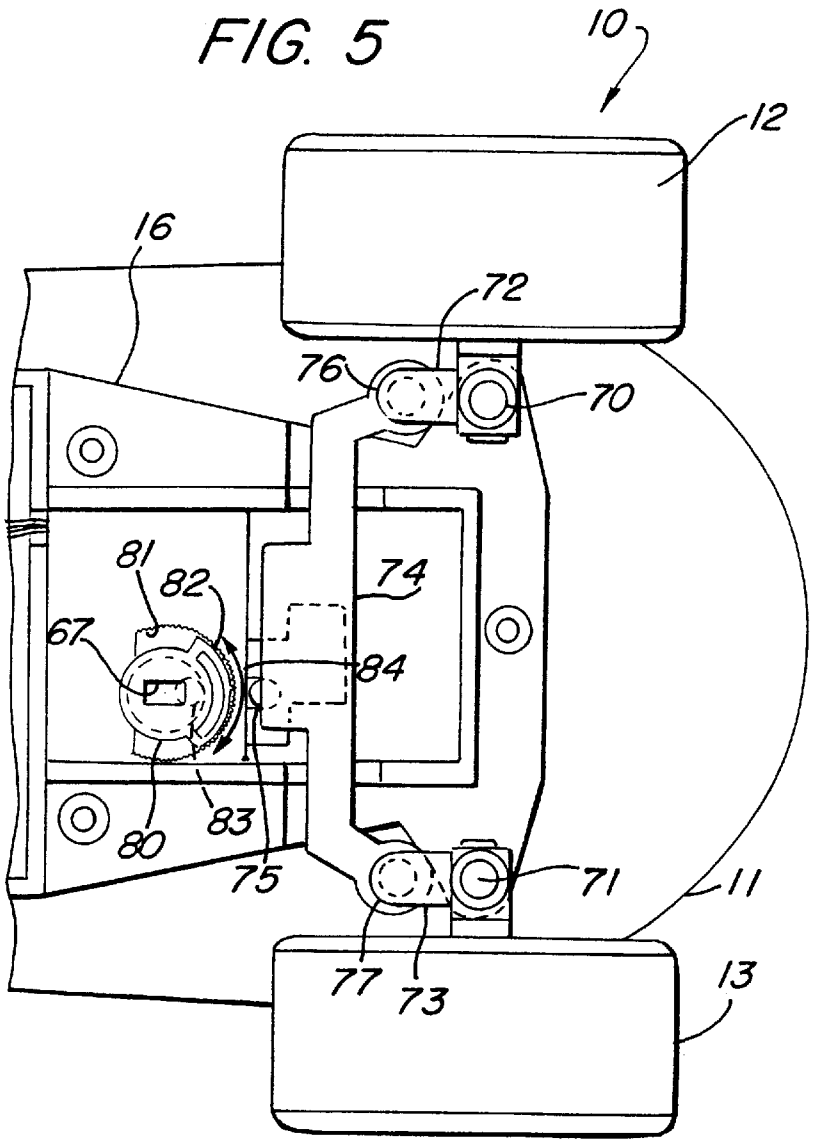
FIG. 5 sets forth a partial section bottom view of the present invention remotely controlled skateboard showing the straight line adjustment feature.

FIG. 5 sets forth a partial bottom view of skateboard 10 having covers 61 and 63 removed to reveal portions of the steering mechanism of skateboard 10. As described above, skateboard 10 includes a board 11 having a supporting chassis 16 which in turn supports a pair of wheels 12 and 13 at the front portion thereof. Wheels 12 and 13 are supported by pivots 70 and 71 which include arms 72 and 73 respectively. Arms 72 and 73 are pivotally secured to a traverse arm 74 by a pair of pivots 76 and 77. Traverse arm 74 further supports a downwardly extending post 75.

Figure 7:
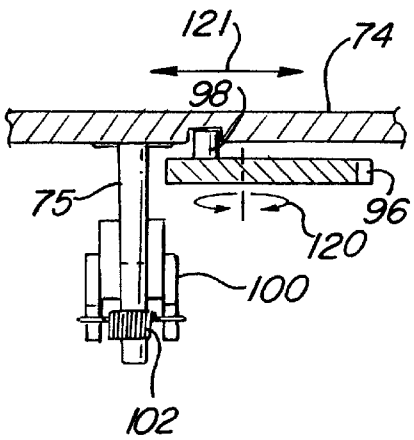
FIG. 7 sets forth a partial section view of the present invention skateboard taken along section lines 7—7 in FIG. 6.
Figure 8:
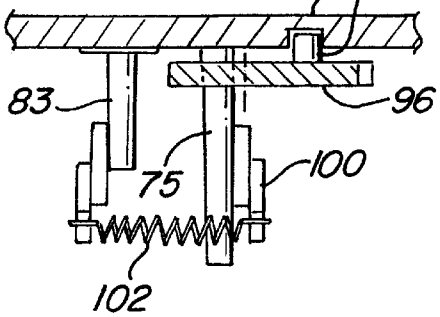
FIG. 8 sets forth the section view of FIG. 7 in response to a steering adjustment.

Skateboard 10 further includes an alignment trim adjuster 80 received within a housing 81 and having a plurality of teeth 82 formed therein. Alignment adjuster trim 80 defines a socket 67 and a downwardly extending pin 83. A tool inserted within socket 67 in the manner described above is used to rotate alignment trim adjuster 80 in the directions indicated by arrows 84 to move pin 83 which in the manner described below in FIGS. 6 through 8 is operative to trim or adjust the normal straight ahead travel of skateboard 10.

Figure 6:
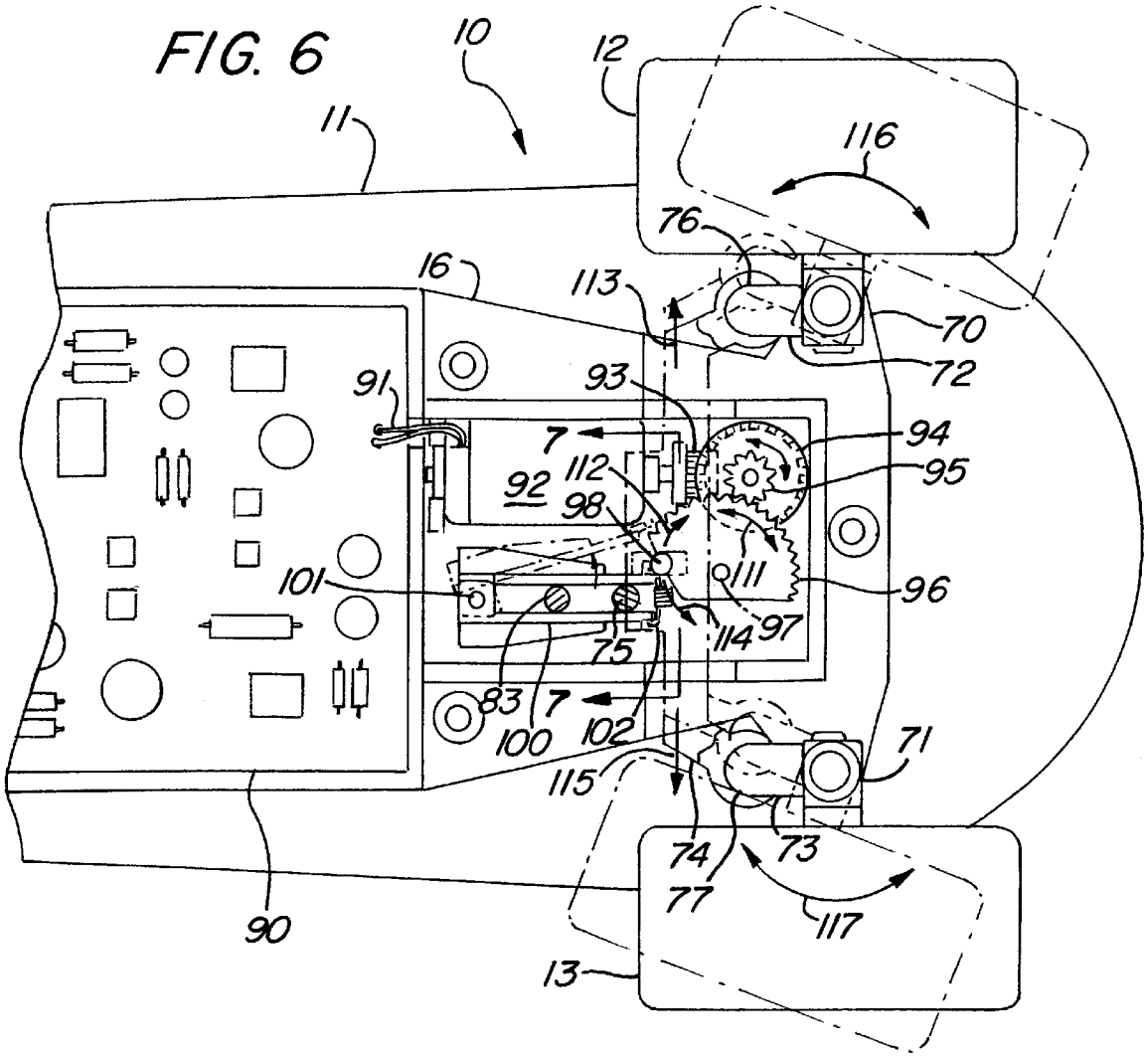
FIG. 6 sets forth a partial section bottom view of the present invention remotely controlled skateboard showing the apparatus for steering the skateboard.

FIG. 6 sets forth a partially sectioned bottom view of the frontal portion of skateboard 10. As described above, skateboard 10 includes a board 11 supported by a chassis 16. A pair of front wheels 12 and 13 are pivotally supported upon chassis 16 by pivots 70 and 71. Wheel 12 includes an arm 73 joined to traverse arm 74 by a pivot 76 while arm 73 is joined to traverse arm 74 by a pivot 77. Chassis 16 further supports a circuit module 90 fabricated in accordance with conventional fabrication techniques, which includes a remote control receiver and motor control units for drive motor 55 (seen in FIG. 3). A steering motor 92 is supported within chassis 16 and is operative coupled to conventional steering circuitry within circuit module 90 by a plurality of wires 91. Motor 92 includes an output gear 93 which in turn is coupled to a gear 94. Gear 94 is joined to a gear 95 which in turn engages a gear 96. Gear 96 is rotatably supported upon a shaft 97 and further includes an upwardly extending pin 98. In the manner better seen in FIG. 7, pin 98 engages traverse arm 74 such that rotational movement of 96 produces side-to-side movement of traverse arm 74.

An alignment pivot 100 is pivotally supported by chassis 16 at a shaft 101. As described above in FIG. 5, alignment trim adjuster 80 includes a pin 83 which is received within alignment pivot 100. As is also described above, traverse arm 74 includes a downwardly extending post 75 which is also received within alignment pivot 100. Alignment pivot 100 includes a spring 102 maintaining the closed position of the components of alignment pivot 100.

In operation, in response to steering commands produced by circuit module 90 in accordance with conventional operational techniques of remote control units, steering motor 92 is activated to provide the appropriate direction of rotation of gear 93. The rotation of gear 93 causes gear 94 and gear 95 to rotate in either direction as indicated by arrows 110. Correspondingly, the rotation of gear 95 produces corresponding rotation in either direction as indicated by arrows 111 of gear 96. The engagement of pin 98 within traverse arm 74 causes pin 98 to move in the directions indicated by arrows 112 and 114 as gear 96 moves. Movement in the direction indicated by arrow 112 moves traverse arm 74 in the direction indicated by arrow 113. Conversely, movement in the direction indicated by arrow 114 by gear 96 causes traverse arm 74 to move in the direction indicated by arrow 115. The coupling of arms 72 and 73 to wheels 12 and 13 produces corresponding pivotal movement of wheels 12 and 13 in the directions indicated by arrows 116 and 117.

FIG. 7 sets forth a partial section view of the steering mechanism of skateboard 10 taken along section lines 7—7. A traverse 74 engages a pin 98 carried by gear 96. Traverse arm 74 further includes a downwardly extending post 75 which is received within alignment pivot 100. Alignment pivot 100 includes a spring 102. Under normal steering operation, gear 96 rotates in either direction as indicted by arrows 120 producing a corresponding lateral movement of traverse arm 74 in the directions indicated by arrows 121.

FIG. 8 sets forth the section view of FIG. 7 in which an adjustment or trim adjustment using alignment trim adjuster 80 (seen in FIG. 5) has been implemented. Thus, traverse arm 74 engages a pin 98 carried by gear 96. Traverse arm further includes a downwardly extending post 75 received within alignment pin 100. In addition, a pin 83 which extends downwardly from alignment trim adjuster (seen in FIG. 5) is also received within alignment pivot 100. In response to a steering command which rotates gear 96 and moves traverse arm 74 in the direction indicated by arrow 122, alignment pivot 100 is able to separate by the extension of spring 102. The position of pin 83 determines the relaxed or center point adjustment of the steering system of skateboard 10.

What has been shown is a remotely controlled skateboard carrying a doll in which the doll includes novel momentum responsive features to simulate the actions of a skateboarding person in a realistic fashion. The momentum features of the skateboarding doll include the pivotal movement of the doll upper torso due to an offset weight supported within the upper torso. Additionally, the doll's arms are freely pivotable at the shoulder joints of the doll to allow arm movement in addition to torso movement as the skateboard imposes various accelerations and momentum changes upon the doll. The doll movement is obtained in a realistic fashion without any resort to motor driven mechanisms.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A skateboard and skateboarding doll in combination, said combination comprising:

a remotely controlled skateboard having a board, a plurality of wheels and chassis supporting said board, and means for moving and steering said skateboard;

a skateboarding doll having a lower torso, a pair of legs, a pair of feet, an upper torso, a pair of arms, said upper and lower torsos having freely pivotable coupling means therebetween; and attachment means for removably securing said pair of feet to said board supporting said skateboarding doll in a generally upright posture upon said skateboard, said upper torso having an offset weight distribution relative to said coupling means causing said upper torso to move with respect to said lower torso in response to acceleration and momentum changes of said skateboard.

2. The combination set forth in claim 1 wherein said upper torso includes a weight secured to said upper torso.

3. The combination set forth in claim 2 wherein said skateboarding doll includes a pair of shoulder joints securing said pair of arms to said upper torso in a freely pivotable attachment, said pair of arms moving in response to acceleration and momentum changes of said skateboard.

4. The combination set forth in claim 3 wherein said attachment means includes a pair of posts extending upwardly from said skateboard and an aperture in each foot in said pair of feet receiving said posts.

5. The combination set forth in claim 4 wherein said upper torso includes an upper plate and wherein said lower torso includes a lower plate and wherein said freely pivotable coupling means pivotably couples said upper and lower plates.

6. The combination set forth in claim 5 said freely pivotable coupling means includes:

an aperture formed in said upper plate;

a post extending upwardly from said lower plate; and an enlarged head formed on said post above said aperture.

7. The combination set forth in claim 6 wherein said upper plate defines a slot and wherein said lower torso includes a pin extending upwardly into said slot, said slot and pin cooperating to limit pivotable movement of said upper torso relative to said lower torso to less than three hundred sixty degrees.

8. The combination set forth in claim 1 wherein said skateboarding doll includes a pair of shoulder joints securing said pair of arms to said upper torso in a freely pivotable attachment, said pair of arms moving in response to acceleration and momentum changes of said skateboard.

9. The combination set forth in claim 1 wherein said attachment means includes a pair of posts extending upwardly from said skateboard and an aperture in each foot in said pair of feet receiving said posts.

10. The combination set forth in claim 8 wherein said attachment means includes a pair of posts extending upwardly from said skateboard and an aperture in each foot in said pair of feet receiving said posts.

11. The combination set forth in claim 10 wherein said upper torso includes an upper plate and wherein said lower torso includes a lower plate and wherein said freely pivotable coupling means pivotably couples said upper and lower plates.

12. The combination set forth in claim 11 said freely pivotable coupling means includes:

an aperture formed in said upper plate;

a post extending upwardly from said lower plate; and an enlarged head formed on said post above said aperture.

13. A skateboard and skateboarding doll in combination, said combination comprising:

a toy skateboard having an upper surface;

a skateboarding doll having a pair of feet, a lower torso, an upper torso and a freely pivoting coupler coupling said lower torso to said upper torso, said upper torso having an non-symmetric weight distribution relative to said pivotable coupling allowing said upper torso to move with respect to said lower torso in response to changes of acceleration and momentum of said toy skateboard; and attachment means for removably securing said feet to said upper surface.

* * * * *